United States Patent [19]

Aschauer

[11] 4,356,716

[45] Nov. 2, 1982

[54] BENDING MACHINE

[75] Inventor: Hans Aschauer, Eferding, Austria

[73] Assignee: Voest-Alpine Aktiengesellschaft, Linz, Austria

[21] Appl. No.: 159,400

[22] Filed: Jun. 13, 1980

[30] Foreign Application Priority Data

Jun. 20, 1979 [AT] Austria ..... 4340/79

[51] Int. Cl.[3] ..... B21D 5/04

[52] U.S. Cl. ..... 72/322; 72/306; 72/450

[58] Field of Search ..... 72/387, 388, 385, 319–323, 72/306, 406, 450

[56] References Cited

U.S. PATENT DOCUMENTS

| | | | |
|---|---|---|---|
| 2,734,552 | 2/1956 | Yonash | 72/322 |
| 3,054,437 | 9/1962 | Laxo | 72/322 |
| 3,058,512 | 10/1962 | Chebuhar et al. | 72/321 |
| 3,621,704 | 11/1971 | Schaeffer | 72/387 |
| 4,055,066 | 10/1977 | Lamendour | 72/388 |
| 4,242,898 | 1/1981 | Salvagnini | 72/307 |

FOREIGN PATENT DOCUMENTS 2839978 3/1979 Fed. Rep. of Germany .

*Primary Examiner*—Daniel C. Crane
*Attorney, Agent, or Firm*—Kurt Kelman

[57] ABSTRACT

A bending machine for flanging sheet metal elements comprises retaining rams for gripping a sheet metal element and at least one drivable bending tool, which is movable about a backing tool that is constituted by an end portion of one retaining ram. To avoid a restriction regarding the path along which the bending tool can be moved, the bending tool is mounted to be movable in two directions, which are approximately at right angles to each other, and separate drive means are provided for moving the bending tools in said two directions, respectively.

7 Claims, 6 Drawing Figures

Figure 3:
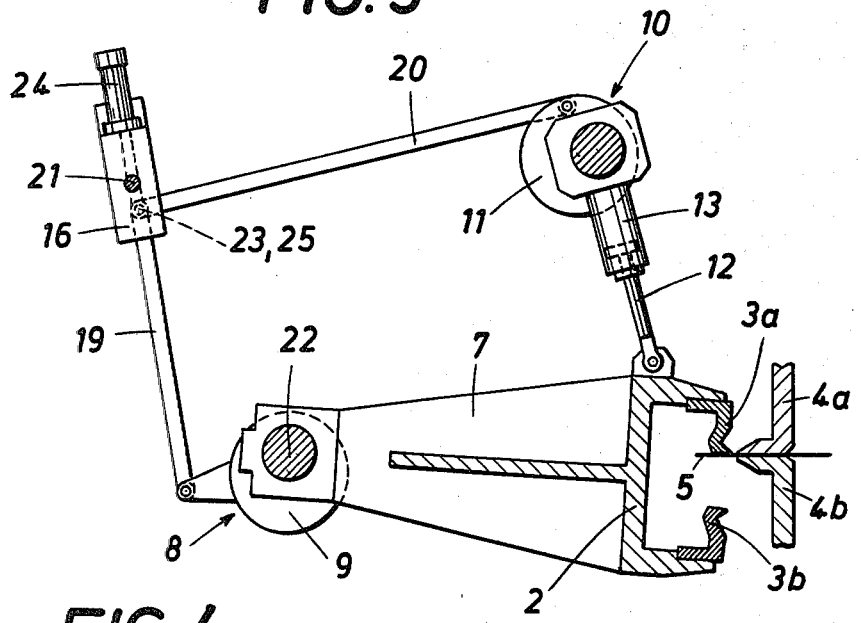

FIG. 1
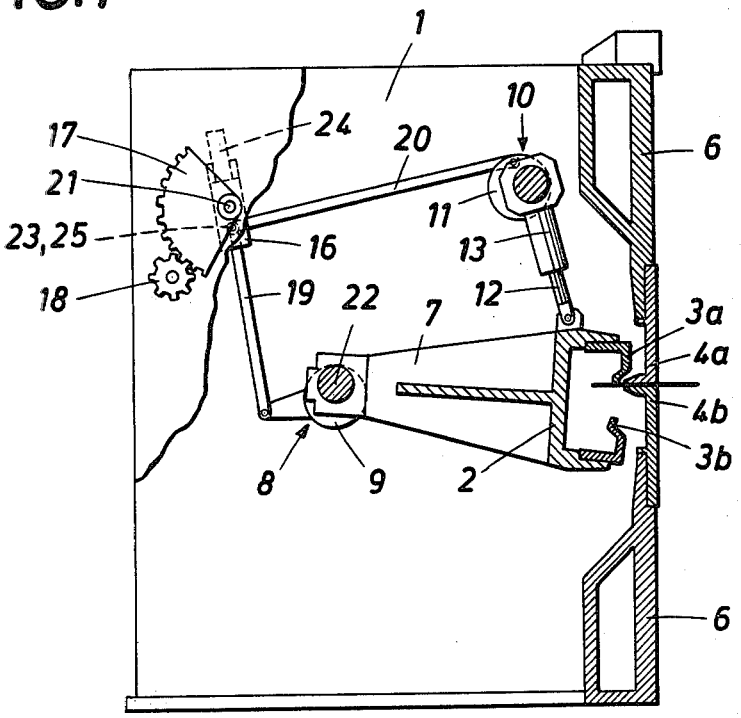
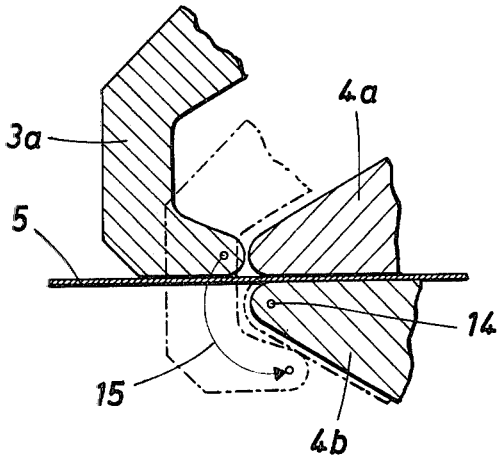
FIG. 2

BENDING MACHINE

This invention relates to a bending machine for flanging sheet metal elements, comprising retaining rams for gripping a sheet metal element and at least one drivable bending tool, which is movable about a backing tool consisting of an end portion of a retaining ram.

In known bending machines of that kind, the bending tool is pivoted on an axis which lies at least approximately in the bending axis so that the bending tool is applying pressure to the sheet metal element always at right angles thereto during the bending operation in which the sheet metal element engaged by the bending tool is bent around the backing tool, which defines the bending axis. These bending machines can bend through angles up to 150°. A disadvantage of these machines resides in that the workpiece can be bent only in one direction adjacent to the bending axis because the bending tool is pivoted. For this reason the sheet metal elements must be turned frequently if they are to be flanged toward different sides. Besides, where a pivoted bending tool is used, the support for the retaining rams will restrict the free space in front of the entrance for the sheet metal elements because the support for the retaining rams must have a sufficiently high torsional strength. This will render the handling of the workpiece more difficult.

Another known bending machine is disclosed in Opened German Specification No. 2,839,978 and comprises an upper bending tool and a lower one. These bending tools are mounted like jaws on the mutually opposite flanges of a channel-shaped tool carrier and by said tool carrier are vertically adjusted relative to a pair of backing tools, which serve also to grip the workpiece. Because the bending tools are driven along a straight path, such bending machine can bend only through angles up to 90° so that the workpiece can be shaped only to designs within a restricted range. The machine has the advantage that it can bend in two directions so that the sheet metal elements need not be turned frequently.

It is an object of the invention so to improve a bending machine of the kind described first hereinbefore that the motion of the bending tool can be selected in accordance with the required flanging of the workpiece and there is no need for a frequent turning of the workpiece.

This object is accomplished according to the invention in that the bending tool is mounted to be movable in two directions, which are substantially at right angles to each other, and two separate drive means are provided for moving the bending tool in the respective directions.

Because the bending tool is movable in two directions, which are approximately at right angles to each other, the tool can theoretically describe any desired path if the two drive means are properly controlled. As the movement of the bending tool is not restricted to a straight path or a circular path, all conditions which may arise can be taken into account. If the backing tools are properly designed, two flanges can be formed in a single operation; this is by no means possible with the known bending machines. Because the motion and drives of the bending tool can be selected without restriction, the workpiece can be bent in different directions so that there is no need for a frequent turning of the workpiece.

According to a preferred further feature of the invention, particularly desirable conditions will be obtained if the direction of the movement imparted by one drive means is approximately parallel to the plane in which the sheet metal element is gripped and the direction of movement imparted by the other drive means is approximately at right angles to that plane. In that case the directions of the movements which are imparted are the main directions of the movements imparted to the workpiece at the beginning and end of the bending operation. This results in a favorable loading and simplifies the control of the drive means.

A particularly simple structure will be obtained if one of the two drive means for the bending tool comprise a crank drive, which comprises a connecting rod that carries the bending tool, and the other drive means are connected to said connecting rod. In such an arrangement, the connecting rod is pivoted to the crankpin of the crank drive so that the bending tool can be moved transversely to the direction of the stroke of the crank drive if the connecting rod is pivotally moved about the crankpin. This simple arrangement will eliminate the need for expensive cam slot mechanisms. A desirable utilization of space will be ensured if the connecting rod which carries the bending tool is approximately parallel to the plane in which the sheet metal element is gripped because the connecting rod will not interfere with the support for the backing tools. The connecting rod must be sufficiently large so that it can support the bending tool. In such an arrangement the support for the backing tools need not protrude on the entrance side of the bending machine so that there is adequate space for the handling of the sheet metal elements.

A crank drive may also constitute the drive means which are connected to the connecting rod of the drive means for imparting the movement in one direction and which serve to impart the movement in the other direction. Such an arrangement will permit a simple adjustment of the two drive means for the desired movement of the workpiece, particularly for circular path sections because this can be accomplished by identical crank drives.

If both drive means consist of crank drives, each crank drive can be driven by a linkage which is pivoted to a common drive rocker. In the simplest case, each linkage may consist of a simple connecting link. The use of a common drive rocker eliminates the need for separate control means for the crank drives. On the other hand, the use of common drive means for the crank drives involves a restriction to a specific path of the tool; that path can be changed only by a change of the mean angular positions of the crank drives, the connecting rods of which are generally rotatable through an angle of less than 180°, or by a change of the transmission ratio of the linkage.

The path described by the tool during the bending operation can be selected so that two bending tools are used which permit a simple bending to opposite sides. For this purpose, a further preferred feature of the invention resides in that the connecting rod belonging to one drive means and extending approximately parallel to the plane in which the sheet metal element is gripped comprises two mutually opposite, jawlike bending tools and the connecting rod belonging to the other drive means and extending at right angles to said plane is adjustable in length in dependence on the spacing of the two bending tools. The connecting rod which moves the bending tool at right angles to said plane must be adjustable in length so that both bending tools can be engaged with the sheet metal element. When one bending tool engages the workpiece, the distance between the other bending tool and the workpiece is equal to the distance between the bending tools. For this reason, the bending tool which is not used at a time can be moved into engagement with the workpiece only in that a pivotal movement is imparted to the connecting rod which carries the bending tools. This can simply be effected in that the connecting rod which belongs to the other drive means and extends transversely to said plane is decreased or increased in length.

If one bending tool is to be disengaged from the workpiece and the other bending tool is to be engaged with the workpiece, the direction of movement of one of the two drive means relative to the path of the workpiece must be reversed. If the two drive means are connected by respective linkages to a common drive rocker, which consists of a two-armed lever, the inversion of motion will be permitted if the pivotal connection between one linkage and the drive rocker is adjustable between two positions on opposite sides of the fulcrum of the drive rocker. Because two points which are diametrically opposite to an axis of rotation move in opposite directions during an angular movement, the adjustment of the pivotal connection for one linkage from one side of the fulcrum to the other will invert the sense of the motion of the crank drive which is connected by said linkage.

Figure 4:
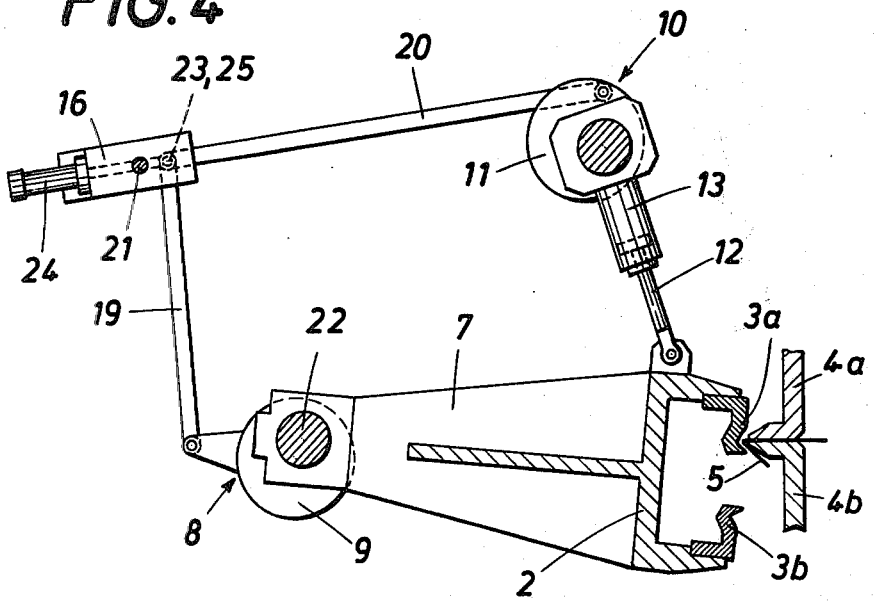
Figure 5:
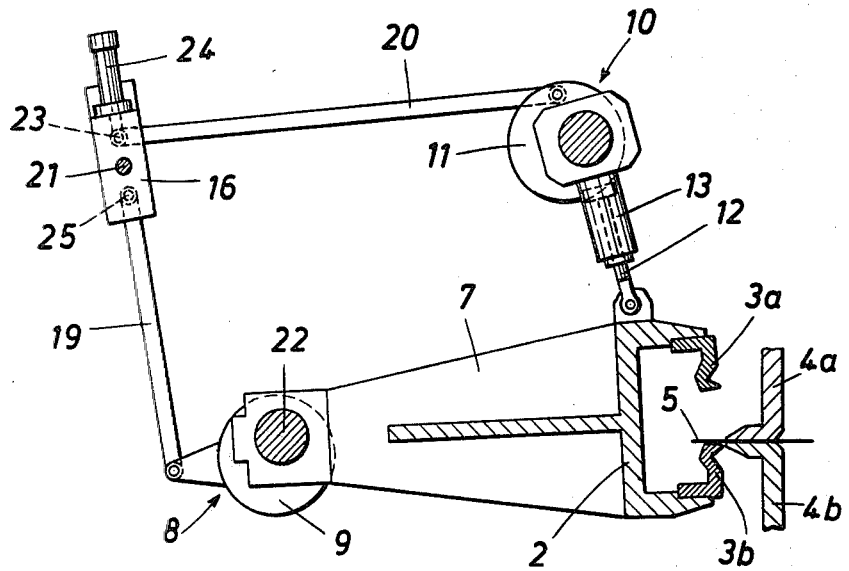
Figure 6:
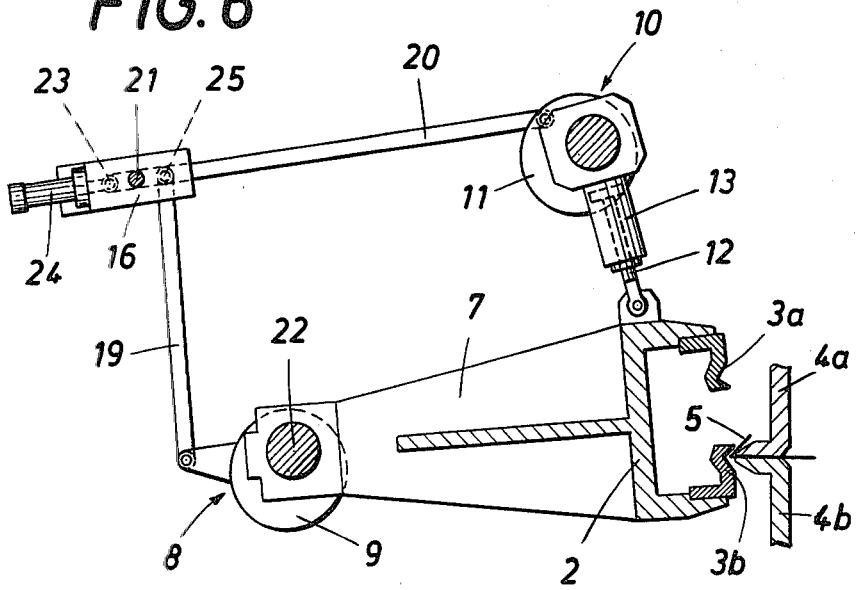

An embodiment of the invention is shown by way of example in the simplified figures of the drawings, in which FIG. 1 is a vertical sectional view showing a bending machine for flanging sheet metal elements in accordance with the invention, FIG. 2 illustrates a possible movement performed by the bending tool during the flanging operation, FIG. 3 shows the position of the drive means for the upper bending tool of a pair of such tools at the beginning of the bending operation, FIG. 4 is a view that is similar to FIG. 3 and shows the positions at the end of the bending operation, FIG. 5 illustrates the use of the lower bending tool of a pair of such tools, and FIG. 6 is a view that is similar to FIG. 4 and illustrates the position of the lower bending tool.

The bending machine shown on the drawings comprises a frame 1 on which channel-shaped tool carrier 2, is mounted. The tool carrier carries two bending tools 3*a* and 3*b* and two retaining rams 4*a* and 4*b*, which constitute backing tools for cooperating with the bending tools 3*a* and 3*b*. The sheet metal element 5 to be flanged is gripped between the retaining rams 4*a* and 4*b*, supported on box-section beams 6, which are rigid in flexion and torsion. The upper one of the box-section beams 6 can be raised and lowered by means which are not shown.

The channel-shaped tool carrier 2 for the bending tools 3*a* and 3*b* is carried by a connecting rod 7 of a crank drive 8. The latter has a crankshaft 9, which is mounted in the frame 1. The crank drive 8 can be used to move the bending tools 3*a* and 3*b* substantially parallel to the plane in which the sheet metal element 5 is gripped. Another crank drive 10 serves to move the bending tools 3*a* and 3*b* in a direction that is transverse to said plane and comprises a crankshaft 11 mounted in the frame 1 and a connecting rod 12, pivoted to the connecting rod 7 of crank drive 8. The connecting rod of crank drive 10 moves transversely to the plane in which the sheet metal element 5 is gripped. To permit of a selective use of the bending tool 3*a* or 3*b*, the connecting rod 12 of the crank drive 10 is adjustable in length. In the embodiment shown by way of example, this adjustment is effected by means of a cylinder 13. When the cylinder 13 is extended, the upper bending tool 3*a* is used, as is shown in FIGS. 1, 3 and 4. For the use of the lower bending tool 3*b* the cylinder 13 must be retracted, as is shown in FIGS. 5 and 6.

Because each of the bending tools 3*a* and 3*b* can be moved transversely to the plane in which the sheet metal element 5 is gripped and parallel to said plane, the bending tools 3*a* and 3*b* can be moved along any desired path if the crank drives 8 and 10 are properly operated. This will result in particularly desirable conditions for the bending operation. For instance, each of the two bending tools can be moved along a circular path around the bending axis 14, as is shown for the upper bending tool 3*a* in FIG. 2. From its initial position shown in solid lines, the bending tool 3*a* moving along the path 15 to its end position indicated by dash-dot lines will bend the sheet metal element 5 about the backing tool constituted by the retaining ram 4*b*. In this way the sheet metal element 5 is bent out of the plane in which it is gripped. The workpiece can thus be bent through angles much in excess of 90°.

Because the bending tool 3*a* or the bending tool 3*b* can be selectively used, the sheet metal element 5 which is to be flanged can be bent upwardly and downwardly so that there is almost no restriction as regards the designs to which the workpiece can be shaped without a need for a frequent turning of the workpiece. In dependence on the operation and control of the crank drives 8 and 10, the path 15 can be changed in shape and size in dependence on the required shape of the workpiece. For this purpose, different bending tools and backing tools may desirably be used.

In the embodiment shown by way of example, the crank drives 8 and 10 are driven by a common drive rocker 16, which consists of a two-armed lever and is adapted to be driven by a gear segment 17 and a pinion 18 in mesh with said segment. The crank drives 8 and 10 are connected to drive rocker 16 by respective linkages 19 and 20, which consist in the simplest case of respective single connecting links. When the drive rocker 16 is pivotally moved about its fulcrum 21 from the position shown in FIG. 3 to the position shown in FIG. 4, the crank drives 8 and 10 will be correspondingly adjusted by means of the linkages 19 and 20 so that the tool 3*a* to be used is advanced by the crank drive 8 toward the retaining rams 4*a* and 4*b* and is simultaneously forced down by the crank drive 10. As a result, the tool is moved along the path 15 indicated in FIG. 2. After that working stroke, the drive rocker 21 returns to its initial position so that the bending tool 3*a* is retracted.

If the other bending tool 3*b* is then to be used, pressure fluid must first be supplied to the cylinder 13 so that the connecting rod 7 of the crank drive 8 is pivotally moved around the crankpin 22 in a sense to engage the bending tool 3*b* with the workpiece. As a result, the bending tool 3*b* assumes the position shown in FIG. 5. Because the workpiece is now being bent in the opposite sense, the lower bending tool 3*b* must be forced upwardly by the crank drive 10 so that the sense of rotation of the crank drive 10 must be reversed. In the embodiment shown by way of example, this is effected by shifting the pivotal connection 23 between the linkage 20 and the drive rocker 16. For this purpose, the drive rocker 16 carries a cylinder 24 having a piston rod which is operable to move the pivotal connection 23 whereas the pivotal connection 25 between the linkage 19 and the drive rocker is not adjusted as the lower bending tool 3*b* must also be advanced toward the retaining rams 4*a* and 4*b* so that a sufficiently large bending angle is obtained. As a result of the shifting of the pivotal connection 23 for the linkage 20 along the drive rocker 16 to the opposite side of the fulcrum 21, the crankshaft 11 of the crank drive 10 is driven in the opposite sense so that the connecting rod 7 is also pivotally moved about the crankpin 22 in the oppposite sense. When the lower bending tool 3*b* is thus driven, said tool will engage the upper retaining ram 4*a* from behind, as is indicated in FIG. 6. In this way, the sheet metal element 5 can be bent downwardly or upwardly in the same manner. The displacements can be changed by a change of the angular movement of the crank drives 8 and 10. This can be effected, e.g., by a change of the angular movement of the drive rocker 16 or by a shifting of the pivotal connections between the linkages 19, 20 and the crank drives or the rocker 16.

What is claimed is:

1. In a bending machine for flanging a sheet metal element, comprising a frame, retaining rams mounted in the frame and operable to grip the sheet metal element, the rams cooperating to define a plane for the gripped sheet metal element, a bending tool mounted in the frame for movement around a respective one of the rams for bending the sheet metal element in cooperation with the respective ram, and two drive means operable independently of each other, a first one of the drive means being operatively connected to the bending tool for moving the bending tool in a first direction substantially parallel to the plane and a second one of the drive means being operatively connected to the bending tool for moving the bending tool in a second direction transversely to the plane, one of the drive means being a crank drive: the improvement of the crank drive including a rigid, one piece connecting rod connected to the crank drive, the bending tool being mounted on the rigid, one piece connecting rod of the crank drive, and the other drive means being connected to the connecting rod of the crank drive.

2. The improvement in the bending machine of claim 1, wherein the connecting rod of the crank drive extends substantially parallel to the plane.

3. The improvement in the bending machine of claim 1 or 2, wherein the other drive means also is a crank drive.

4. The improvement in the bending machine of claim 1 or 2, wherein two of said bending tools are mounted on the connecting rod of the crank drive, the two bending tools being disposed opposite each other, and the other drive means also is a crank drive, the other crank drive including a longitudinally adjustable connecting rod linked to the connecting rod of the one crank drive.

5. In a bending machine for flanging a sheet metal element, comprising a frame, retaining rams mounted in the frame and operable to grip the sheet metal element, the rams cooperating to define a plane for the gripped sheet metal element, a bending tool mounted in the frame for movement around a respective one of the rams for bending the sheet metal element in cooperation with the respective ram, and two crank drives operable independently of each other, a first one of the crank drives being operatively connected to the bending tool for moving the bending tool in a first direction substantially parallel to the plane and a second one of the crank drives being operatively connected to the bending tool for moving the bending tool in a second direction transversely to the plane: the improvement of one of the crank drives including a rigid, one piece connecting rod connected to the one crank drive, the bending tool being mounted on the rigid, one piece connecting rod of the crank drive, the other crank drive being connected to the connecting rod of the one crank drive, a common drive rocker for the crank drives for driving said crank drives, and linkages connecting the drive rocker to the crank drives.

6. A bending machine for flanging a sheet metal element, comprising a frame, retaining rams mounted in the frame and operable to grip the sheet metal element, the rams cooperating to define a plane for the gripped sheet metal element, two bending tools mounted in the frame for movement around a respective one of the rams for bending the sheet metal element in cooperation with the respective ram, the two bending tools being disposed opposite each other, two crank drives operable independently of each other, a first one of the crank drives including a rigid, one piece connecting rod connected to the one crank drive, the two bending tools being mounted on the rigid, one piece connecting rod of the one crank drive and the one crank drive being operable for moving the bending tools on the connecting rod in a first direction substantially parallel to the plane, the other crank drive including a longitudinally adjustable connecting rod connected to the other crank drive and linked to the rigid connecting rod of the one crank drive, the other crank drive being operable for moving the bending tools in a second direction transversely to the plane, a common drive rocker for the crank drives for driving said crank drives, the drive rocker having a fulcrum about which the rocker is pivotal, and linkages connecting the drive rocker to the crank drives, one of the linkages having a pivoting connection to the drive rocker, which is adjustable with respect to the fulcrum thereof.

7. A bending machine for flanging a sheet metal element, comprising a frame, retaining rams mounted in the frame and operable to grip the sheet metal element, the rams cooperating to define a plane for the gripped sheet metal element, two bending tools mounted in the frame for movement around a respective one of the rams for bending the sheet metal element in cooperation with the respective ram, the two bending tools being disposed opposite each other, two crank drives operable independently of each other, a first one of the crank drives including a rigid, one piece connecting rod connected to the one crank drive, the two bending tools being mounted on the rigid, one piece connecting rod of the one crank drive and the one crank drive being operable for moving the bending tools on the connecting rod in a first direction substantially parallel to the plane, the other crank drive including a longitudinally adjustable connecting rod connected to the other crank drive and linked to the rigid connecting rod of the one crank drive, the other crank drive including a connecting rod adjustable in length at least to an extent equalling the distance between the two oppositely disposed bending tools, the adjustable connecting rod being linked to the rigid connecting rod of the one crank drive and the other crank drive being operable to move the bending tools in a second direction transversely to the plane.

* * * * *